US009341401B2

(12) United States Patent
Nikaido et al.

(10) Patent No.: US 9,341,401 B2
(45) Date of Patent: May 17, 2016

(54) HEAT SOURCE SYSTEM AND CONTROL METHOD THEREFOR

(75) Inventors: Satoshi Nikaido, Tokyo (JP); Kazuki Wajima, Tokyo (JP); Akimasa Yokoyama, Tokyo (JP); Masanobu Sakai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 436 days.

(21) Appl. No.: 13/812,790

(22) PCT Filed: Oct. 27, 2011

(86) PCT No.: PCT/JP2011/074801

§ 371 (c)(1),
(2), (4) Date: Jan. 28, 2013

(87) PCT Pub. No.: WO2012/090579

PCT Pub. Date: Jul. 5, 2012

(65) Prior Publication Data

US 2013/0125573 A1 May 23, 2013

(30) Foreign Application Priority Data

Dec. 28, 2010 (JP) ..... 2010-294245

(51) Int. Cl.
*F25B 49/02* (2006.01)
*F25B 41/04* (2006.01)

(52) U.S. Cl.
CPC ..... *F25B 49/022* (2013.01); *F25B 41/04* (2013.01); *F25B 2339/047* (2013.01); *F25B 2400/0401* (2013.01); *F25B 2600/02* (2013.01);

(Continued)

(58) Field of Classification Search
CPC ..... F25B 49/00; F25B 49/02; F25B 49/022; F25B 2600/02
See application file for complete search history.

(56) References Cited

U.S. PATENT DOCUMENTS 4,457,138 A * 7/1984 Bowman ..... 62/196.1
2010/0094434 A1* 4/2010 Ballet et al. ..... 700/28

FOREIGN PATENT DOCUMENTS

CN 101542218 A 9/2009
JP 4-347432 A 12/1992

(Continued)

OTHER PUBLICATIONS

JP 2008-175476 (English Translation).*

(Continued)

*Primary Examiner* — Jonathan Bradford
(74) *Attorney, Agent, or Firm* — Westerman, Hattori, Daniel & Adrian, LLP

(57) ABSTRACT

Provided is a heat source system that includes two heat source devices connected in series to a heat medium and can be efficiently operated. A heat source system (1) reduces the temperature of chilled water that is guided from a cooling load and has a predetermined return temperature Tr, to a predetermined supply temperature Ts, and supplies the chilled water to the cooling load. The heat source system (1) includes: a second centrifugal chiller (TR2) that reduces the temperature of the chilled water from the return temperature Tr to an intermediate temperature T2; a first centrifugal chiller (TR1) that reduces the temperature of the chilled water that has been reduced to the intermediate temperature T2 by the second centrifugal chiller (TR2), to the supply temperature Ts; and a control unit (9) that variably sets the intermediate temperature T2.

3 Claims, 9 Drawing Sheets

(52) U.S. Cl.
CPC . *F25B2600/2501* (2013.01); *F25B 2600/2513* (2013.01); *F25B 2700/21161* (2013.01); *F25B 2700/21171* (2013.01)

(56) References Cited

FOREIGN PATENT DOCUMENTS

| | | | |
|---|---|---|---|
| JP | 5-093550 | A | 4/1993 |
| JP | 11-264625 | A | 9/1999 |
| JP | 2001-355938 | A | 12/2001 |
| JP | 2007-127321 | A | 5/2007 |
| JP | 2007-198693 | A | 8/2007 |
| JP | 2008-175476 | A | 7/2008 |

OTHER PUBLICATIONS

International Search Report for PCT/JP2011/074801, mailing date of Jan. 24, 2012.

Chinese Office Action dated Oct. 10, 2014, issued in corresponding Chinese Patent Application No. 201180034659.3, w/English translation (25 pages).

Decision to Grant a Patent dated May 18, 2015, issued in counterpart Chinese Patent Application No. 201180034659.3 (2 pages).

Office Action dated Jul. 7, 2015, issued in counterpart Japanese Patent Application No. 2010-294245, with English translation. (13 pages).

* cited by examiner

HEAT SOURCE SYSTEM AND CONTROL METHOD THEREFOR

TECHNICAL FIELD

The present invention relates to a heat source system including heat source devices connected in series to a heat medium and a control method therefor.

BACKGROUND ART

In general, a heat source device (for example, a centrifugal chiller and an absorption chiller) that supplies chilled water (heat medium) to a heat load of an air conditioner or the like is operated under rated conditions so as to cool chilled water at, for example, 12° C. up to 7° C. and supply the chilled water to the heat load. According to a known configuration for enabling the supply of chilled water having a temperature difference larger than such a rated temperature difference of 5° C., two heat source devices are connected in series to the chilled water (see, for example, PTL 1). According to this configuration, for example, the upstream heat source device cools the chilled water from 17° C. to 12° C., and the downstream heat source device cools the chilled water from 12° C. to 7° C., thus enabling an operation with a temperature difference of 10° C. from 17° C. to 7° C.

CITATION LIST

Patent Literature

{PTL 1}
Japanese Unexamined Patent Application, Publication No. 2001-355938

SUMMARY OF INVENTION

Technical Problem

The conventional heat source system described above is designed on the premise that each heat source device is operated at a rated temperature difference of 5° C. Accordingly, an intermediate temperature (12° C.) between a chilled water return temperature (17° C.) and a chilled water supply temperature (7° C.) is a fixed value. Further, in general, the temperature of chilled water that is supplied from the heat source system in response to a request from a heat load is a set value (for example, 7° C.) in many cases. Then, in the case where the demand of the heat load decreases and where the chilled water return temperature thus becomes lower, if the intermediate temperature is fixed, the downstream heat source device operates so as to cool the chilled water from 12° C. to 7° C., whereas the upstream heat source device needs to perform a partial load operation with a temperature difference of 5° C. or less from a temperature lower than 17° C. (for example, 15° C.) to 12° C. For example, assuming that the lowered return temperature is 15° C., the load factor in this case is calculated by (15° C.−12° C.)/5° C.=60%. Under the circumstances, originally, the temperature of the chilled water outputted by the upstream heat source device is higher than that outputted by the downstream heat source device, and hence the upstream heat source device can operate at a higher COP. Nevertheless, if the intermediate temperature is a fixed value, in the case where the demand of the heat load decreases, only the downstream heat source device having a relatively low COP operates at a load factor of 100%, whereas the upstream heat source device capable of operating at a high COP operates at a low load factor, that is, can hardly operate.

This is not an efficient operation as the overall heat source system, and hence further improvement in this regard is desired.

The present invention, which has been made in view of the above-mentioned circumstances, has an object to provide a heat source system that includes two heat source devices connected in series to a heat medium and can be efficiently operated and a control method therefor.

Solution to Problem

In order to solve the above-mentioned problem, a heat source system and a control method therefor according to the present invention adopt the following solutions.

That is, the present invention provides a heat source system that changes a temperature of a heat medium that is guided from a heat load and has a predetermined return temperature, to a predetermined supply temperature, and supplies the heat medium to the heat load, the heat source system including: an upstream heat source device that changes the temperature of the heat medium from the return temperature to an intermediate temperature; a downstream heat source device that changes the temperature of the heat medium that has been changed to the intermediate temperature by the upstream heat source device, to the supply temperature; and a control unit that variably sets the intermediate temperature.

According to the heat source system of the present invention, the upstream heat source device and the downstream heat source device sequentially change (for example, reduces) the temperature of the heat medium, whereby the heat medium with a large temperature difference is supplied. In such a heat source system, the upstream heat source device operates so as to change the temperature of the heat medium from the return temperature to the intermediate temperature, and the downstream heat source device operates so as to change the temperature of the heat medium from the intermediate temperature to the supply temperature. Specifically, the output (load factor) of each heat source device is determined in accordance with the temperature difference from the intermediate temperature. In the present invention, because the control unit variably sets the intermediate temperature, the load factor of each heat source device can be changed as appropriate. Accordingly, an operation with reduced consumed power and consumed electricity, an operation with reduced operation costs, and the like can be achieved as the overall heat source system.

Examples of the heat source device include an electric centrifugal chiller, an absorption chiller, and an air-cooled heat pump.

Moreover, in a heat source system according to a first aspect of the present invention, the upstream heat source device and/or the downstream heat source device is an electric centrifugal chiller, and the control unit sets the intermediate temperature such that consumed power according to a load factor of the electric centrifugal chiller is equal to or less than a predetermined value.

In the electric centrifugal chiller, the consumed power (consumed electricity) of an electric compressor and the like changes in accordance with the load factor (the rated load is defined as 100%). The control unit sets the intermediate temperature such that the consumed power is equal to or less than the predetermined value. As a result, an operation with smaller consumed power is achieved.

Note that, in the case where the intermediate temperature is changed within a range possible for the electric centrifugal chiller, it is preferable that the intermediate temperature be set such that the consumed power is substantially the smallest. For example, the intermediate temperatures possible for the electric centrifugal chiller are selected at at least three points, and the consumed powers are obtained at the three points. Then, a quadratic curve is obtained on the basis of the combination of the intermediate temperatures and the consumed powers at the three points, the intermediate temperature at which the consumed power is a minimum value is calculated, and the intermediate temperature thus calculated is set.

Note that it is preferable to consider, at the time of computing the consumed power, the temperature of the heat medium outputted by the centrifugal chiller and the temperature of water for cooling a condenser of the centrifugal chiller.

The electric centrifugal chiller may be a fixed speed device including an electric compressor that turns at a fixed speed, may be a variable speed device including an electric compressor that turns at a given speed, and may be the combination of the fixed speed device and the variable speed device.

Moreover, in a heat source system according to a second aspect of the present invention, the upstream heat source device and/or the downstream heat source device is an absorption chiller, and the control unit sets the intermediate temperature such that operation costs of the absorption chiller are equal to or less than a predetermined value.

The absorption chiller is driven by a heat source of steam or the like. The control unit sets the intermediate temperature such that operation costs depending on costs of the heat source are equal to or less than a predetermined value. As a result, an operation with lower operation costs is achieved.

Moreover, in a heat source system according to a third aspect of the present invention, the upstream heat source device is a heat recovery device that absorbs thermal energy from the heat medium and outputs the thermal energy to another thermal load, and the control unit sets the intermediate temperature so as to achieve an amount of necessary heat absorption determined by the thermal energy output by the heat recovery device.

In the case where the upstream heat source device is the heat recovery device, the heat recovery device absorbs thermal energy from the heat medium, and outputs predetermined thermal energy required by another thermal load. The control unit sets the intermediate temperature so as to achieve the amount of heat absorption necessary to enable the output of the required predetermined thermal energy. As a result, the heat recovery device can output the predetermined thermal energy to another thermal load.

Further, the present invention provides a control method for a heat source system that changes a temperature of a heat medium that is guided from a heat load and has a predetermined return temperature, to a predetermined supply temperature, and supplies the heat medium to the heat load, the heat source system including: an upstream heat source device that changes the temperature of the heat medium from the return temperature to an intermediate temperature; and a downstream heat source device that changes the temperature of the heat medium that has been changed to the intermediate temperature by the upstream heat source device, to the supply temperature, the control method including variably setting, by a control unit, the intermediate temperature.

According to the control method for a heat source system of the present invention, the upstream heat source device and the downstream heat source device sequentially changes (for example, reduces) the temperature of the heat medium, whereby the heat medium with a large temperature difference is supplied. In such a heat source system, the upstream heat source device operates so as to change the temperature of the heat medium from the return temperature to the intermediate temperature, and the downstream heat source device operates so as to change the temperature of the heat medium from the intermediate temperature to the supply temperature. Specifically, the output (load factor) of each heat source device is determined in accordance with the temperature difference from the intermediate temperature. In the present invention, because the control unit variably sets the intermediate temperature, the load factor of each heat source device can be changed as appropriate. Accordingly, an operation with reduced consumed power and consumed electricity, an operation with reduced operation costs, and the like can be achieved as the overall heat source system.

Examples of the heat source device include an electric centrifugal chiller, an absorption chiller, and an air-cooled heat pump.

Advantageous Effects of Invention

Because the intermediate temperature is variably set, the load factor of each heat source device can be changed as appropriate, and an operation with reduced consumed electricity, an operation with reduced operation costs, and the like can be achieved as the overall heat source system.

DESCRIPTION OF EMBODIMENTS

Hereinafter, embodiments of the present invention are described with reference to the drawings.

First Embodiment

Hereinafter, a first embodiment of the present invention is described.

Figure 1:
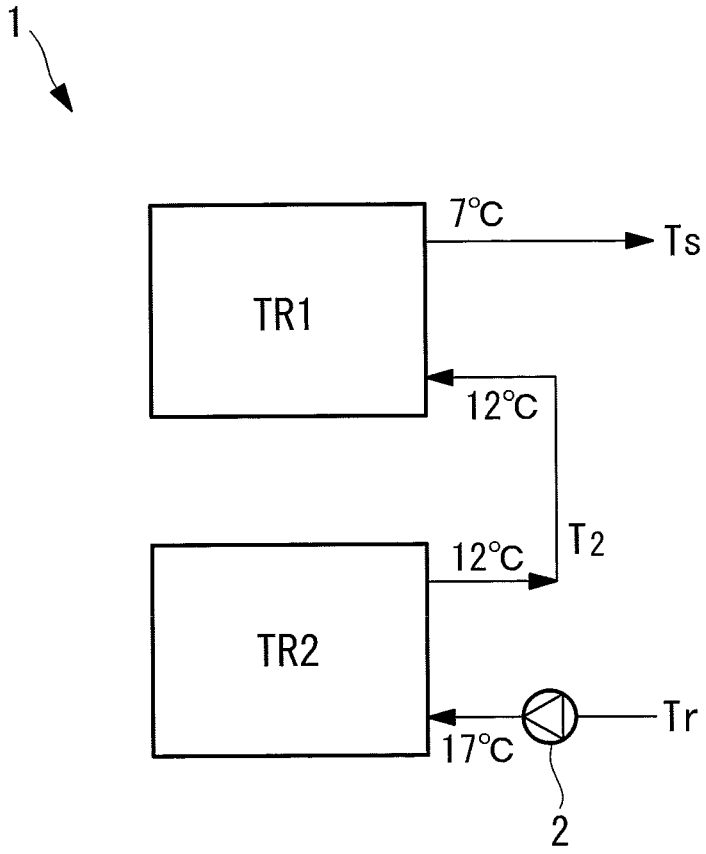
FIG. 1 is a schematic diagram illustrating a heat source system according to a first embodiment of the present invention.

FIG. 1 illustrates a heat source system 1 according to the present embodiment. The heat source system 1 includes a first centrifugal chiller (downstream heat source device) TR1 and a second centrifugal chiller (upstream heat source device) TR2. The centrifugal chillers TR1 and TR2 are electric centrifugal chillers each including a compressor driven by an electric motor. The centrifugal chillers TR1 and TR2 each supply chilled water (heat medium) to a cooling load of an air conditioner or the like (not illustrated). The second centrifugal chiller TR2 and the first centrifugal chiller TR1 are connected in the stated order from the upstream side to a flow of the chilled water. Accordingly, the chilled water, which is circulated between the centrifugal chillers TR1 and TR2 and the cooling load by a constant-flow chilled water pump 2, flows into the second centrifugal chiller TR2 at a return temperature Tr, and is cooled up to an intermediate temperature T2. Then, the chilled water flows into the first centrifugal chiller TR1 at the intermediate temperature T2, and is cooled up to a supply temperature Ts. The centrifugal chillers TR1 and TR2 each have the capability to lower the temperature of the chilled water by 5° C. under rated conditions (at a load factor of 100%), and FIG. 1 illustrates temperatures when each centrifugal chiller operates under the rated conditions. That is, the second centrifugal chiller TR2 cools the chilled water from the return temperature of 17° C. to the intermediate temperature of 12° C., and the first centrifugal chiller TR1 cools the chilled water from the intermediate temperature of 12° C. to the supply temperature of 7° C.

The supply temperature Ts is normally designed so as to be set to a temperature required by the cooling load. Accordingly, the heat source system 1 is controlled such that the supply temperature Ts is the set temperature (typically, 7° C.). Meanwhile, the return temperature Tr changes depending on fluctuations of the amount of heat required by the cooling load, and, under the rated conditions, the return temperature Tr is a temperature (typically, 17° C.) obtained by accumulating a temperature difference (typically, 10° C.) corresponding to the sum of respective rated temperature differences of the centrifugal chillers TR1 and TR2.

In the present embodiment, the intermediate temperature T2 is not a fixed value, and a control unit (not illustrated) can change as appropriate the intermediate temperature T2 in accordance with the quantities of state such as the return temperature Tr.

Figure 2:
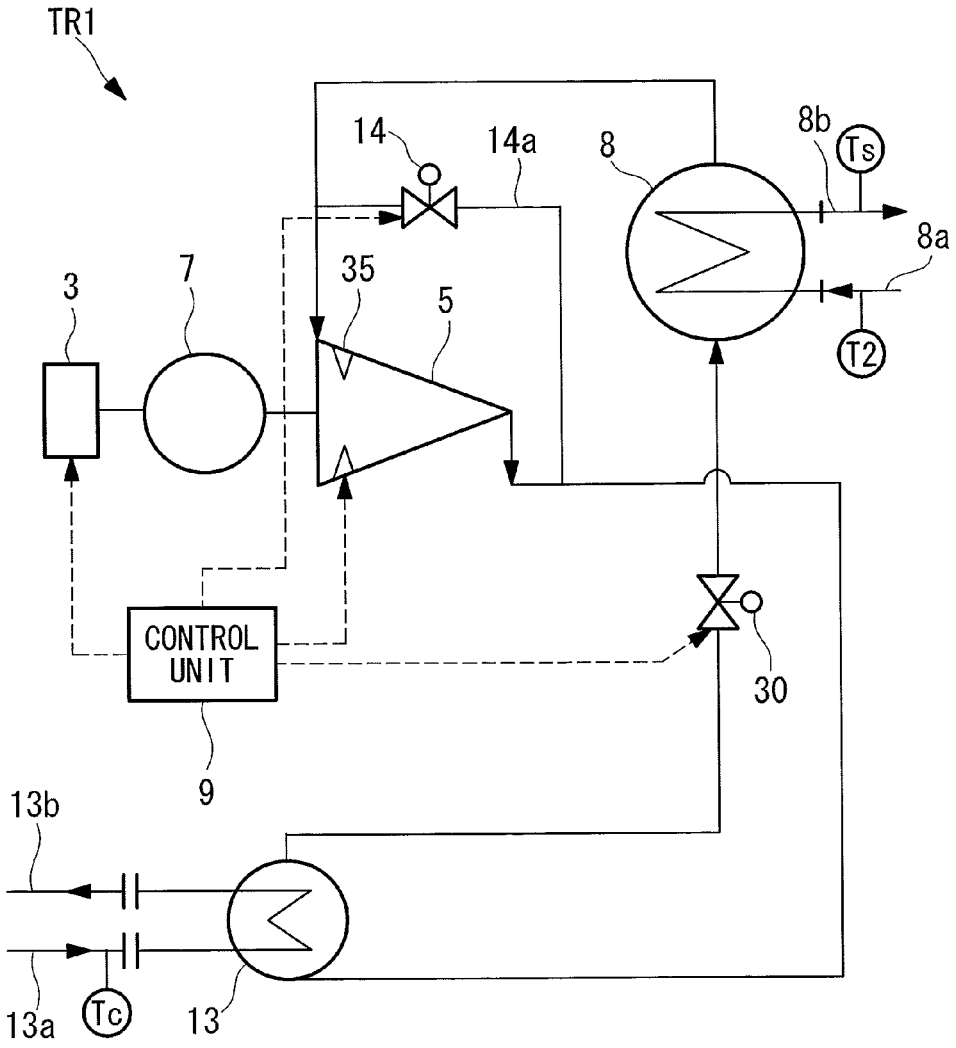
FIG. 2 is a schematic configuration diagram illustrating a centrifugal chiller illustrated in FIG. 1.

FIG. 2 illustrates a schematic configuration of the first centrifugal chiller TR1. Note that the configuration of the second centrifugal chiller TR2 is the same thereas, and hence description thereof is omitted.

As illustrated in FIG. 2, the first centrifugal chiller TR1 includes: a centrifugal compressor 5 that compresses a refrigerant; a condenser 13 that condenses and liquefies the compressed refrigerant; an expansion valve 30 that reduces the pressure of the condensed liquid refrigerant to expand the same; an evaporator 8 that evaporates the expanded liquid refrigerant; and a control unit 9.

The centrifugal compressor 5 is an electric centrifugal compressor rotationally driven by an electric motor 7. The electric motor 7 is electrically connected to an inverter apparatus 3, and the inverter apparatus 3 enables the electric motor 7 to perform a variable speed operation.

The inverter apparatus 3 controls the number of revolutions of the electric motor 7 on the basis of a command of the control unit 9.

The condenser 13 is, for example, a shell-and-tube heat exchanger. Cooling water pipes 13*a* and 13*b* are connected to the condenser 13, and water flowing through the cooling water pipes 13*a* and 13*b* exchanges heat with a refrigerant in the shell. The cooling water pipes 13*a* and 13*b* are connected to a cooling tower (not illustrated). A temperature sensor is provided to the cooling water pipe 13*a*, and can measure an entrance temperature Tc of the cooling water flowing into the condenser 13.

The evaporator 8 is a shell-and-tube heat exchanger. Chilled water pipes 8*a* and 8*b* are connected to the evaporator 8, and water flowing through the chilled water pipes 8*a* and 8*b* exchanges heat with a refrigerant in the shell. The entrance chilled water pipe 8*a* is connected to a chilled water exit side of the second centrifugal chiller TR2, and the exit chilled water pipe 8*b* is connected to the cooling load. A chilled water entrance temperature sensor that measures the supply temperature Ts after heat exchange is provided upstream of the exit chilled water pipe 8*b*, and an intermediate temperature sensor that measures the intermediate temperature T2 after cooling by the second centrifugal chiller TR2 is provided downstream of the entrance chilled water pipe 8*a*.

Note that, in the case of the second centrifugal chiller TR2, a return temperature sensor that measures the return temperature Tr is provided to an entrance chilled water pipe thereof.

An entrance vane 35 is provided on a refrigerant suction side of the centrifugal compressor 5. The entrance vane 35 adjusts the flow rate of the refrigerant flowing into the centrifugal compressor 5. The degree of opening of the entrance vane 35 is controlled by the control unit 9. The supply temperature Ts is controlled by adjusting the degree of opening of the entrance vane 35.

A hot gas bypass pipe 14*a* is provided between the discharge side of the centrifugal compressor 5 and the suction side of the centrifugal compressor 5. A hot gas bypass valve 14 for adjusting the flow rate of the refrigerant is provided to the hot gas bypass pipe 14*a*. The high-temperature high-pressure discharged refrigerant, the flow rate of which is adjusted by the hot gas bypass valve 14, is bypassed to the suction side of the centrifugal compressor 5. The degree of opening of the hot gas bypass valve 14 is controlled by the control unit 9.

The expansion valve 30 is provided between the condenser 13 and the evaporator 8, and throttles the liquid refrigerant to thereby achieve isenthalpic expansion.

The degree of opening of the expansion valve 30 is controlled by the control unit 9.

Figure 3:
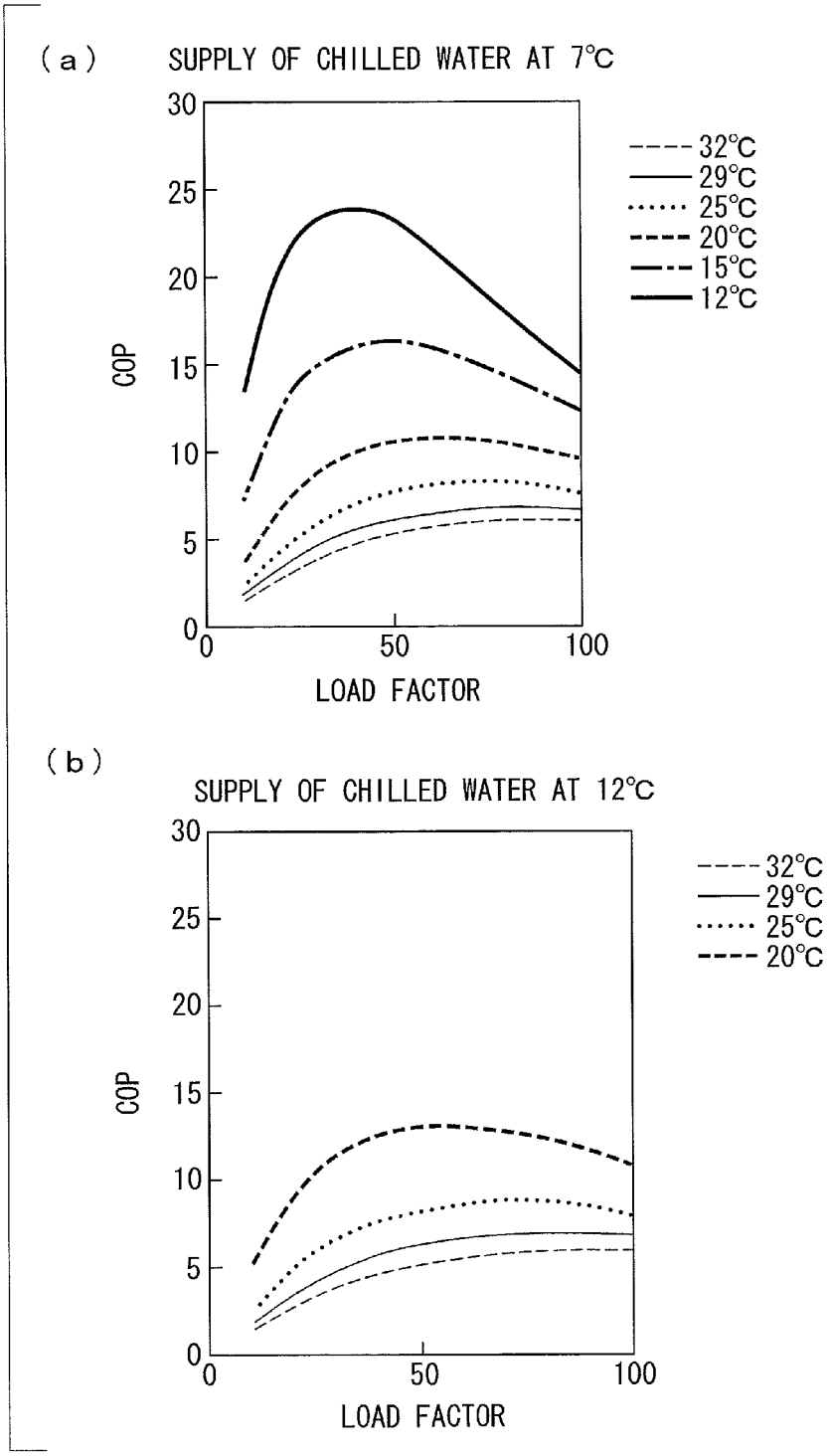
FIG. 3 are maps each illustrating a COP of the centrifugal chiller to a load factor.

The control unit of the heat source system 1 includes such maps as illustrated in FIG. 3 in its storage area. The horizontal axis of each of the maps illustrated in FIG. 3 shows a load factor, and the vertical axis thereof shows a coefficient of performance (COP). Each map illustrates the COP to the load factor for each cooling water entrance temperature Tc. In the case where the rated load is 100% and where the flow rate of the chilled water is constant, the load factor is proportional to a temperature difference in water chilled by each centrifugal chiller. Accordingly, in the case where a temperature difference of 5° C. is defined as a rated load factor of 100%, a temperature difference of 3° C. corresponds to a load factor of 60%. As illustrated in FIG. 3, the COP changes in accordance with the load factor (that is, a temperature difference) and the cooling water entrance temperature.

FIG. 3(*a*) illustrates a map in which the exit chilled water temperature is 7° C., and FIG. 3(*b*) illustrates a map in which the exit chilled water temperature is 12° C. As illustrated in FIGS. 3(*a*) and 3(*b*), the map shape and the optimal load factor are different depending on the exit chilled water temperature. For example, FIG. 3(*a*), the exit chilled water temperature of which is 7° C., corresponds to a map of the first centrifugal chiller TR1, and FIG. 3(*b*), the exit chilled water temperature of which is 12° C., corresponds to one of maps used for the second centrifugal chiller TR2.

Note that an external wet-bulb temperature may be adopted in place of the cooling water entrance temperature Tc.

The control unit of the heat source system 1 achieves an efficient operation of the heat source system 1 using such characteristics of the electric centrifugal chiller. That is, the control unit sets as appropriate the intermediate temperature T2, and adjusts the load factor of each of the centrifugal chillers TR1 and TR2, whereby a high-COP operation is achieved as the overall heat source system 1. The control method for this is described below.

Figure 4:
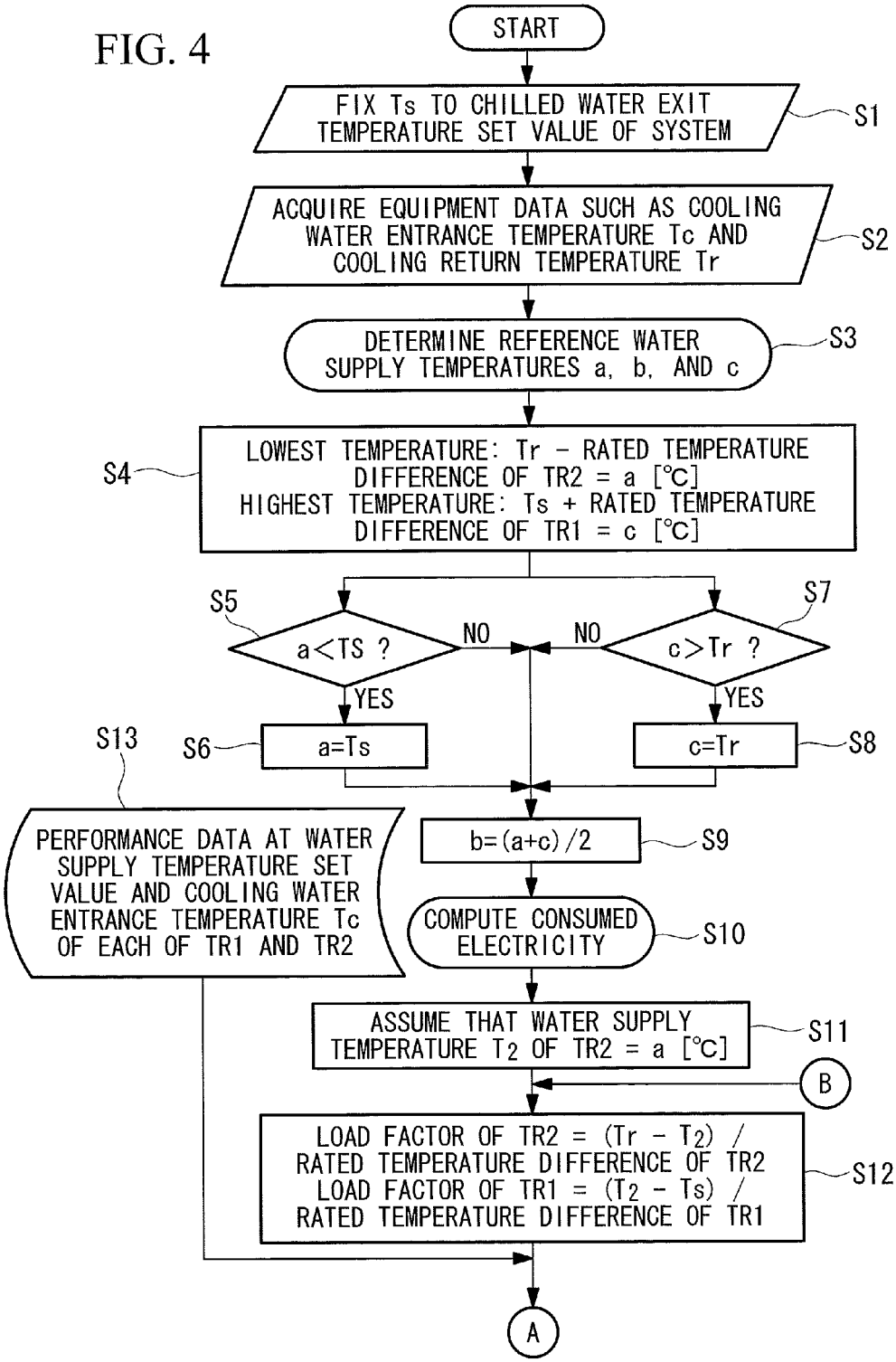
FIG. 4 is a flow chart illustrating a method of setting an intermediate temperature.
Figure 5:
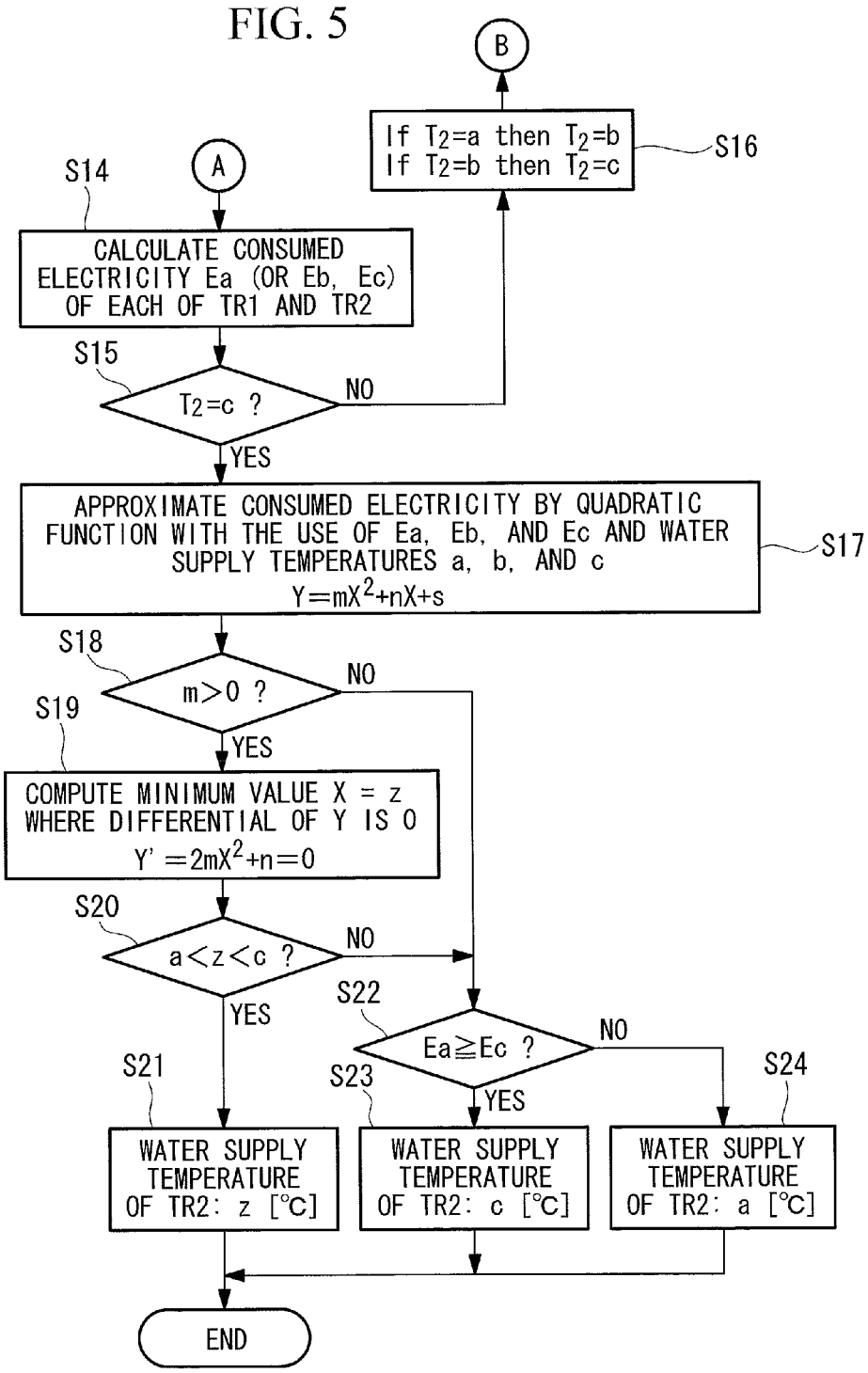
FIG. 5 is a flow chart illustrating the method of setting the intermediate temperature.

FIG. 4 and FIG. 5 illustrate a method of setting the intermediate temperature T2 by the heat source system 1 having the above-mentioned configuration.

First, the control unit of the heat source system 1 fixes the supply temperature Ts to a chilled water exit temperature set value (for example, 7° C.) required for the heat source system 1 (Step S1).

Next, the control unit acquires the cooling water entrance temperature Tc and the return temperature Tr from equipment such as the cooling tower and the cooling load provided separately from the centrifugal chillers (Step S2).

Then, the control unit starts a step of determining three reference water supply temperatures a, b, and c (Step S3).

Specifically, in Step S4, the control unit determines a [° C.] as the lowest temperature possible for the second centrifugal chiller TR2 in the following manner.

$$a = \text{return temperature } Tr - \text{rated temperature difference of second centrifugal chiller} \quad (1)$$

If the lowest temperature a thus determined is less than the supply temperature Is (Step S5), the control unit sets the lowest temperature a to the supply temperature Is (Step S6). If NO, the control unit uses the lowest temperature a as it is.

Similarly, in Step S4, the control unit determines c [° C.] as the highest temperature possible for the second centrifugal chiller TR2 in the following manner.

$$c = \text{supply temperature } Ts - \text{rated temperature difference of first centrifugal chiller} \quad (2)$$

If the highest temperature c thus determined is more than the return temperature Tr (Step S7), the control unit sets the highest temperature c to the return temperature Tr (Step S8). If NO, the control unit uses the highest temperature c as it is.

Next, in Step S9, the control unit obtains an average temperature b as an arithmetic average of the lowest temperature a and the highest temperature c determined as described above.

Then, in Step S10 and the subsequent steps, the control unit computes consumed electricity of each of the centrifugal chillers TR1 and TR2.

First, the control unit assumes that the intermediate temperature T2 that is the water supply temperature of the second centrifugal chiller TR2 is the lowest temperature a (Step S11). Then, in Step S12, the control unit computes the load factor of each of the centrifugal chillers TR1 and TR2. The load factor is defined as the ratio of a chilled water temperature difference to a rated temperature difference at the rated load of each centrifugal chiller. Then, the control unit refers to the maps illustrated in FIG. 3 in the storage area. Specifically, in Step S13, the control unit refers to: performance data at the supply temperature Ts (set value) and the cooling water entrance temperature Tc of the centrifugal chiller TR1; and performance data at the exit chilled water temperature (that is, the intermediate temperature T2=a [° C.]) of the second centrifugal chiller TR2. In Step S14, the control unit calculates consumed electricity Ea of each of the centrifugal chillers TR1 and TR2. The consumed electricity can also be calculated according to the methods described in Japanese Unexamined Patent Application, Publication No. 2010-236728 and Japanese Patent Application No. 2009-265296, instead of referring to the maps of FIG. 3.

Further, the control unit similarly calculates consumed electricity Eb at the average temperature b and consumed electricity Ec at the highest temperature c (Steps S15 and S16).

Next, in Step S17, the control unit approximates the consumed electricity by the following quadratic function with the use of the relation of (Ea, Eb, Ec)=(a, b, c).

$$Y = mX^2 + nX + s \quad (3)$$

where Y represents the consumed electricity and X represents the intermediate temperature.

After such approximation by the quadratic function, as shown in Steps S18 to S24, the control unit solves a minimum value problem for the quadratic function, in the zone equal to or more than a and equal to or less than c.

In this way, the control unit determines the intermediate temperature T2 at which the consumed electricity is the smallest.

The control unit controls the centrifugal chillers TR1 and TR2 with the intermediate temperature T2 determined as described above being set.

Example

The intermediate temperature was computed using specific numerical values in the following manner.

In this example, the intermediate temperature was computed assuming that two inverter (variable speed) centrifugal chillers of 200 refrigeration ton (Rt) were placed in series.

The rated chilled water temperature of the first centrifugal chiller TR1 was set to 7° C./12° C.

The rated chilled water temperature of the second centrifugal chiller TR2 was set to 12° C./17° C.

1. Acquisition of the equipment load (Steps S1 and S2 of FIG. 4)

Water supply temperature setting of heat source system; Ts=7° C.

Data acquired from equipment; cooling water temperature Tc=20° C., and return temperature Tr=13° C.

2. Extraction of the water supply temperature at three points (Steps S4 to S9 of FIG. 4)

$$a = Tr - \text{rated temperature difference of } TR2 = 13 - 5 = 8°\ \text{C.}$$

$$c = Ts + \text{rated temperature difference of } TR1 = 7 + 5 = 12°\ \text{C.}$$

$$b = (a+c)/2 = (8+12)/2 = 10°\ \text{C.}$$

3. Computation of the consumed electricity at the three points (Step S10 of FIG. 4 to Step S16 of FIG. 5).

4. Approximation by the quadratic function and definition of T2 having the minimum value as a set value of the intermediate temperature (Steps S17 to S24 of FIG. 5).

Figure 6:
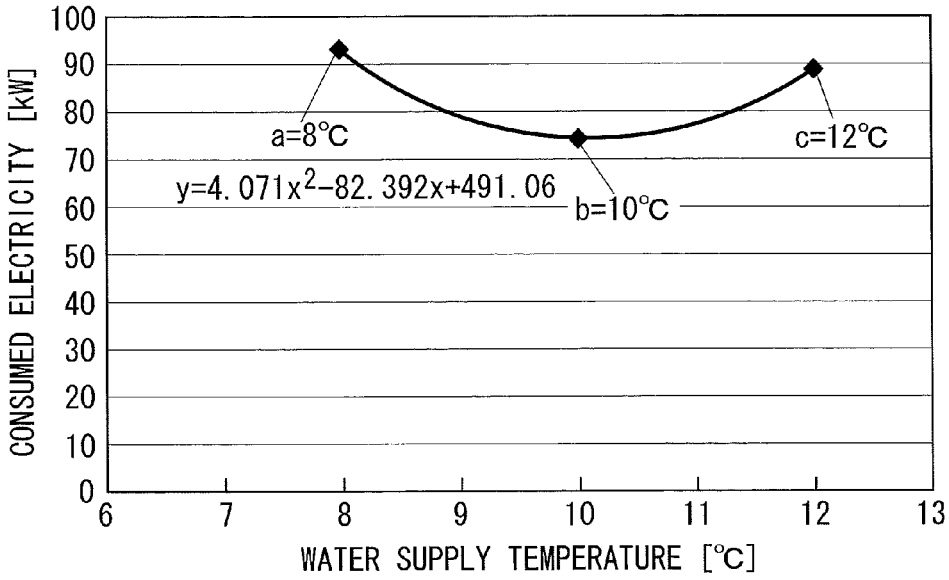
FIG. 6 is a graph illustrating an example for computing the intermediate temperature.

As a result of such computation as described above, the quadratic function is $4.071X^2 - 82.392X + 481.06$ (see FIG. 6), and an $X^2$ coefficient is positive. Hence, the graph of FIG. 6 is convex downward. When X whose differential function is 0 is obtained, X≈10.1° C. because 8.142X−82.392=0. Accordingly, the optimal temperature set value is 10.1° C.

The total consumed electricity of the two centrifugal chillers TR1 and TR2 at this time is 74.2 kW, which is significantly smaller than a consumed electricity of 88.6 kW when temperature setting of the first centrifugal chiller TR1 is kept at a rated value (that is, T2=12° C.)

As described above, according to the present embodiment, the control unit variably sets the intermediate temperature T2, and hence the load factor of each of the centrifugal chillers TR1 and TR2 can be changed as appropriate. Accordingly, an operation with reduced consumed power, that is, consumed electricity can be achieved as the overall heat source system 1. Specifically, in the case where the intermediate temperature is changed within a range possible for each of the centrifugal chillers TR1 and TR2, the intermediate temperature is set such that the consumed power is substantially the smallest, and hence the consumed electricity can be remarkably reduced.

The intermediate temperatures T2 possible for each of the centrifugal chillers TR1 and TR2 are selected at at least three points, and the consumed powers are obtained at the three points. Then, a quadratic curve is obtained on the basis of the combination of the intermediate temperatures and the consumed powers at the three points, whereby the intermediate temperature at which the consumed electricity is a minimum value is calculated. Hence, the calculation load of the control unit can be reduced.

Note that, in the present embodiment, description is given on the premise of the configuration in which variable speed centrifugal chillers each including an inverter are used for the centrifugal chillers TR1 and TR2, but the present invention can also be applied to fixed speed centrifugal chillers each including an electric compressor that turns at a fixed speed. That is, the combination of the centrifugal chillers TR1 and TR2 may be the combination of a fixed speed device and a fixed speed device, and may be the combination of an inverter and a fixed speed device.

Further, the capacities of the centrifugal chillers TR1 and TR2 may be the same, and may be different, for example, 500 Rt and 1,000 Rt.

Further, in the case where one of the two centrifugal chillers TR1 and TR2 breaks down, it is preferable that the chilled water exit set temperature of the other centrifugal chiller that does not break down be forcedly changed to the set value (7° C.) of the supply temperature Ts, thus enabling the supply of the chilled water having a desired temperature.

Further, as a result of such computation as described above, in the case where the optimal intermediate temperature is 7° C., that is, where it is determined that one of the centrifugal chillers is to be stopped, the second centrifugal chiller TR2 located on the upstream side of the chilled water flow is stopped. This is because, if the first centrifugal chiller TR1 located on the downstream side of the chilled water flow is stopped, the chilled water that is supplied at 7° C. from the second centrifugal chiller TR2 is subjected to heat exchange by the first centrifugal chiller TR1, so that the chilled water temperature rises to, for example, 8° C.

Further, the second centrifugal chiller TR2 may be a heat recovery device. The heat recovery device absorbs thermal energy from the chilled water, and outputs predetermined thermal energy required by another thermal load. Accordingly, the control unit sets the intermediate temperature T2 so as to achieve the amount of heat absorption necessary to enable the output of the predetermined thermal energy required by another thermal load. As a result, the heat recovery device can output the predetermined thermal energy to another thermal load.

Further, in the present embodiment, the centrifugal chillers are described as an example of the heat source devices, but the heat source devices may be other heat source devices, for example, absorption chillers. Consumed electricity of the absorption chillers is dramatically smaller than that of the electric centrifugal chillers. Hence, when the optimal intermediate temperature T2 is determined, it is preferable to use, as an index, operation costs depending on heat sources necessary for the absorption chillers. Examples of the operation costs include: the amount of fuel consumed by a heating burner; and costs for obtaining steam in the case of steam heating.

Second Embodiment

Next, a second embodiment of the present invention is described.

Figure 7:
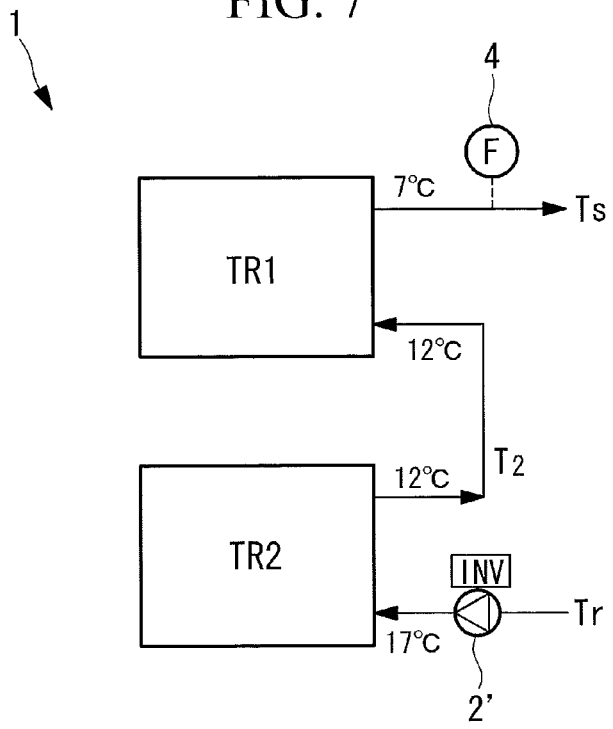
FIG. 7 is a schematic diagram illustrating a heat source system according to a second embodiment of the present invention.

As illustrated in FIG. 7, the present embodiment is different from the first embodiment illustrated in FIG. 1 in that: a chilled water pump 2' has a variable flow rate driven by an inverter; and that a flowmeter 4 that measures the flow rate of chilled water is provided. The present embodiment is the same as the first embodiment in the other configurations, and hence description thereof is omitted.

In the present embodiment, because the flow rate of the chilled water is variable, control according to the variable flow rate is possible. That is, in the first embodiment, because the flow rate of the chilled water is constant, the load is regarded as being proportional to the temperature difference, and special correction is unnecessary. In contrast, in the present embodiment, correction based on the variable flow rate of the chilled water is performed. For this correction, the control unit acquires a flow rate F [$m^3$/h], specific heat c [J/g·K], and specific gravity ρ [g/$m^3$] of the chilled water.

Figure 8:
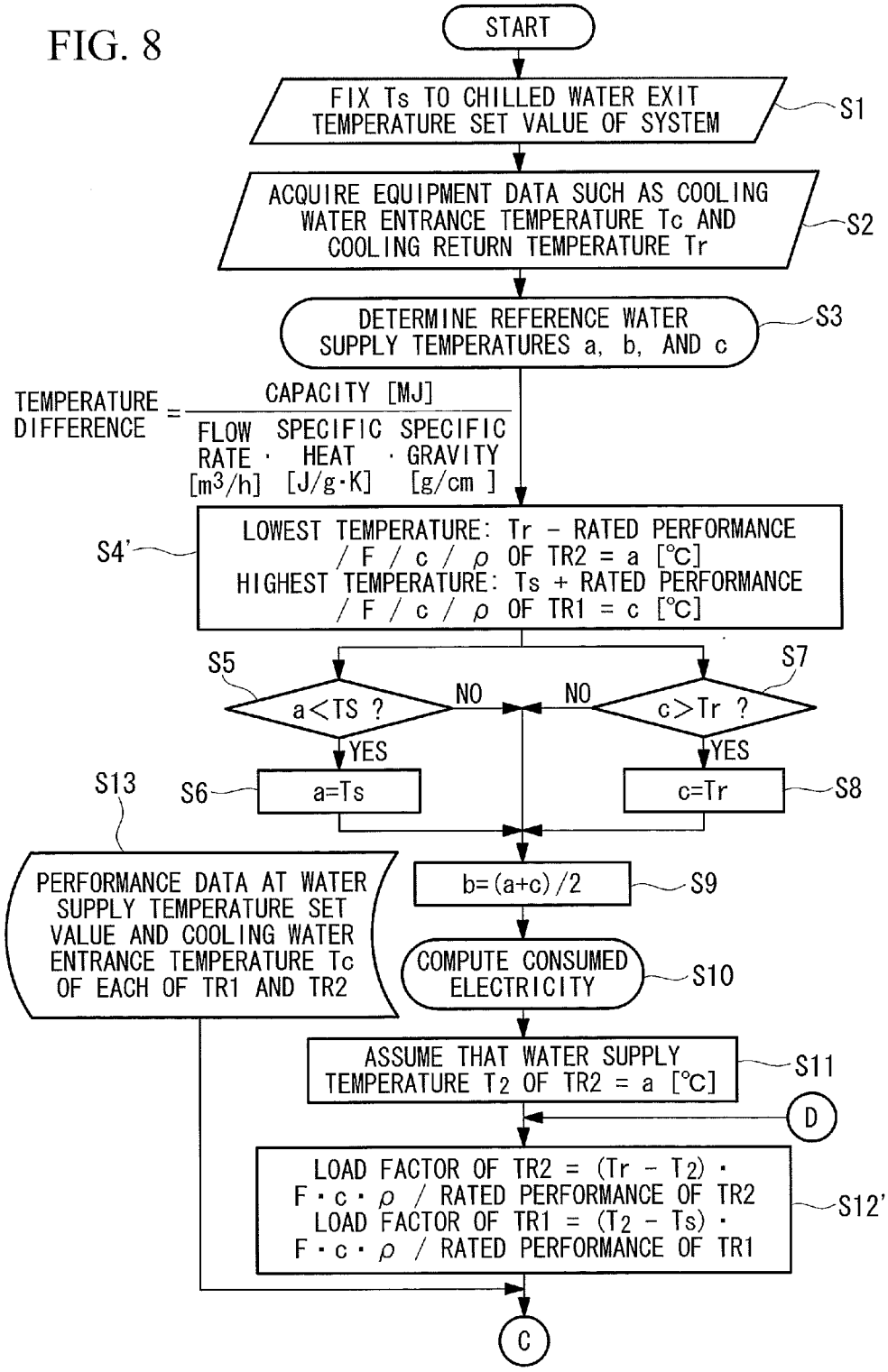
FIG. 8 is a flow chart illustrating a method of setting an intermediate temperature.
Figure 9:
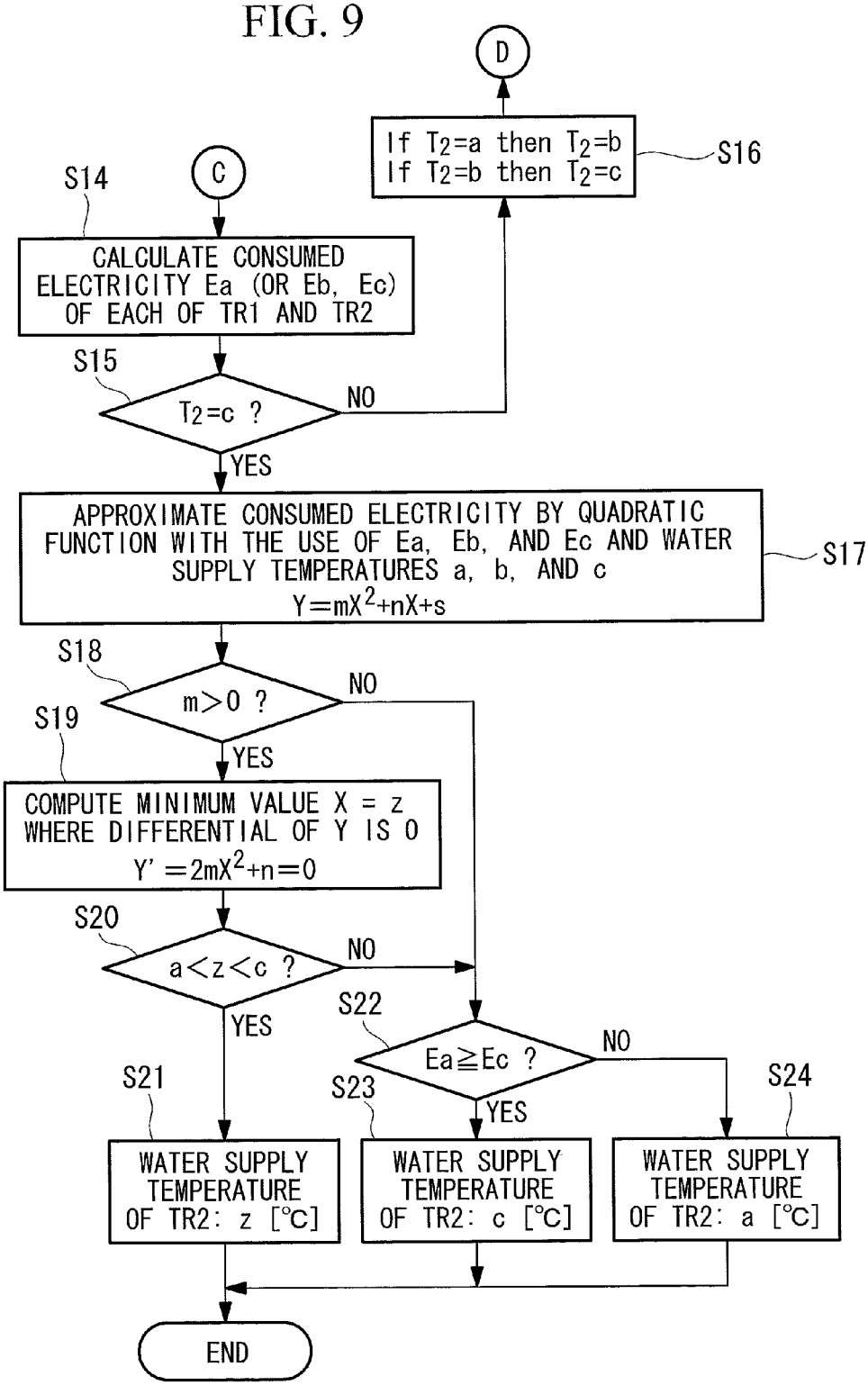
FIG. 9 is a flow chart illustrating the method of setting the intermediate temperature.

For the correction based on the variable flow rate of the chilled water, as shown in Step S4' and Step S12' of FIG. 8, the rated temperatures used in Step S4 and Step S12 of FIG. 4 in the first embodiment are corrected using the flow rate F, the specific heat c, and the specific gravity ρ. Specifically, the rated temperatures are corrected using the relation in the following expression.

$$\text{Temperature difference } \Delta T = \text{refrigerating capacity } [MJ]/(\text{flow rate } F \times \text{specific heat } c \times \text{specific gravity } \rho) \quad (4)$$

In this way, according to the present embodiment, even in the case where the flow rate of the chilled water varies, the heat source system 1 can be efficiently controlled similarly to the first embodiment.

Third Embodiment

Figure 10:
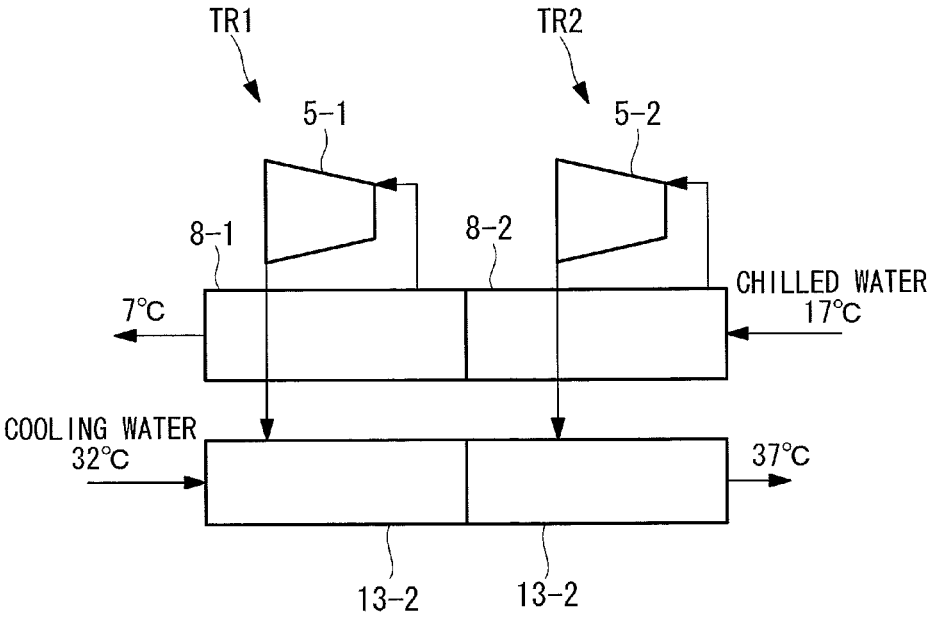
FIG. 10 is a schematic diagram illustrating a heat source system according to a third embodiment of the present invention.

As illustrated in FIG. 10, the present invention can also be applied to a heat source system including centrifugal chillers of double refrigeration cycle type. The first embodiment and the second embodiment assume that the water for cooling the condenser of each of the centrifugal chillers TR1 and TR2 has an independent configuration, but the present invention can be similarly applied to a double refrigeration cycle in which condensers are connected in series to cooling water as illustrated in FIG. 10.

The first centrifugal chiller TR1 includes a low-pressure stage compressor 5-1, a low-pressure stage evaporator 8-1, and a low-pressure stage condenser 13-1. The second centrifugal chiller TR2 includes a high-pressure stage compressor 5-2, a high-pressure stage evaporator 8-2, and a high-pressure stage condenser 13-2.

The chilled water flows in at, for example, 17° C., and is cooled up to an intermediate temperature by the high-pressure stage evaporator 8-2. After that, the chilled water is cooled up to a supply temperature (for example, 7° C.) by the low-pressure stage evaporator 8-1. The cooling water flows in at, for example, 32° C., and absorbs heat in the low-pressure stage condenser 13-1 to increase its temperature. After that, the cooling water absorbs heat in the high-pressure stage condenser 13-2 to further increase its temperature (for example, 37° C.).

Figure 11:
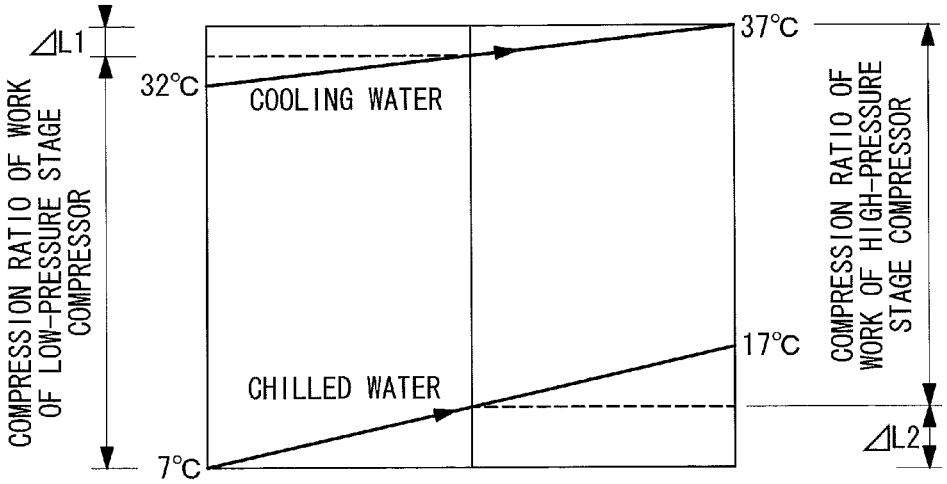
FIG. 11 is a graph illustrating an operation of a double refrigeration cycle of FIG. 10.

Such a double refrigeration cycle has an advantage that power corresponding to ΔL1 and ΔL2 can be cut down as illustrated in FIG. 11.

The present embodiment is the same as the first embodiment and the second embodiment in that the control unit of the heat source system sets as appropriate the intermediate temperature of the chilled water after being cooled by the high-pressure stage evaporator 8-2 and before flowing into the low-pressure stage evaporator 8-1, to thereby perform control with the consumed electricity being the smallest, and hence description thereof is omitted.

REFERENCE SIGNS LIST

1 heat source system
TR1 first centrifugal chiller (downstream heat source device)
TR2 second centrifugal chiller (upstream chiller heat source device)
Tr return temperature
Ts supply temperature
T2 intermediate temperature

The invention claimed is:

1. A heat source system that changes a temperature of a heat medium that is guided from a heat load and has a predetermined return temperature, to a predetermined supply temperature, and supplies the heat medium to the heat load, the heat source system comprising:

an upstream heat source device that changes the temperature of the heat medium from the return temperature to an intermediate temperature;

a downstream heat source device that changes the temperature of the heat medium that has been changed to the intermediate temperature by the upstream heat source device, to the supply temperature; and a control unit that variably sets the intermediate temperature, wherein the upstream heat source device and/or the downstream heat source device is an electric centrifugal chiller, and the control unit calculates consumed power according to a load factor of the electric centrifugal chiller using a potential intermediate temperature within a range possible for the upstream heat source device and the downstream heat source device and sets the intermediate temperature such that the consumed power is equal to or less than a predetermined value.

2. A heat source system that changes a temperature of a heat medium that is guided from a heat load and has a predetermined return temperature, to a predetermined supply temperature, and supplies the heat medium to the heat load, the heat source system comprising:

an upstream heat source device that changes the temperature of the heat medium from the return temperature to an intermediate temperature;

a downstream heat source device that changes the temperature of the heat medium that has been changed to a potential intermediate temperature by the upstream heat source device, to the supply temperature; and a control unit that variably sets the intermediate temperature, wherein the upstream heat source device and/or the downstream heat source device is an absorption chiller, and the control unit calculates operation costs according to a load factor of the absorption chiller using the intermediate temperature within a range possible for the upstream heat source device and the downstream heat source device and sets the intermediate temperature such that the operation costs are equal to or less than a predetermined value.

3. A heat source system that changes a temperature of a heat medium that is guided from a heat load and has a predetermined return temperature, to a predetermined supply temperature, and supplies the heat medium to the heat load, the heat source system comprising:

an upstream heat source device that changes the temperature of the heat medium from the return temperature to an intermediate temperature;

a downstream heat source device that changes the temperature of the heat medium that has been changed to the intermediate temperature by the upstream heat source device, to the supply temperature; and a control unit that variably sets the intermediate temperature, wherein the upstream heat source device is a heat recovery device that absorbs thermal energy from the heat medium and outputs the thermal energy to another thermal load, and the control unit sets the intermediate temperature so as to achieve an amount of necessary heat absorption determined by the thermal energy output by the heat recovery device.

* * * * *